US008177535B2

(12) United States Patent
Moldt et al.

(10) Patent No.: US 8,177,535 B2
(45) Date of Patent: May 15, 2012

(54) METHOD FOR TIMING A POLYMER PUMP CONTAINING POLYMER

(75) Inventors: David T. Moldt, Lake Jackson, TX (US); James H. Everitt, Lake Jackson, TX (US)

(73) Assignee: Equistar Chemicals, LP, Houston, TX (US)

( * ) Notice: Subject to any disclaimer, the term of this patent is extended or adjusted under 35 U.S.C. 154(b) by 832 days.

(21) Appl. No.: 12/313,336

(22) Filed: Nov. 19, 2008

(65) Prior Publication Data

US 2010/0124512 A1 May 20, 2010

(51) Int. Cl.

| | |
|---|---|
| ***F01C 1/18*** | (2006.01) |
| ***F01C 1/24*** | (2006.01) |
| ***F04C 2/18*** | (2006.01) |
| ***F04C 2/24*** | (2006.01) |
| ***B23P 6/00*** | (2006.01) |
| ***B23P 15/00*** | (2006.01) |

(52) U.S. Cl. ..... 418/206.2; 418/1; 418/205; 418/206.1; 29/888.021; 29/888.023

(58) Field of Classification Search ..... 418/1, 109, 418/205, 206.1, 206.2; 29/888, 888.02, 888.011, 29/888.021, 888.023

See application file for complete search history.

(56) References Cited

U.S. PATENT DOCUMENTS 6,210,139 B1 * 4/2001 Ramanathan et al. ..... 418/206.4
6,254,367 B1 * 7/2001 Seiling ..... 418/206.1

* cited by examiner

*Primary Examiner* — Mary A Davis

(57) ABSTRACT

A method for restoring the registry of opposed shafts that carry meshing pump teeth inside a polymer pump that contains polymer without removing polymer from within the pump, the method using an asymmetric pattern of apertures in the shaft ends and a template having a pattern of holes that matches the pattern of apertures, and dowels that closely fit the holes and apertures.

6 Claims, 8 Drawing Sheets

METHOD FOR TIMING A POLYMER PUMP CONTAINING POLYMER

BACKGROUND OF THE INVENTION

1. Field of the Invention

This invention relates to timing the registry of meshing teeth in a polymer pump that contains polymer.

2. Description of the Prior Art

Pumping apparatus that pumps molten polymer (polymer) and pressurizes that polymer can contain a pair of opposed shafts, each shaft carrying teeth that force viscous polymer from the inlet of the pump to its outlet. The pressure under which the polymer exists at the outlet of the pump is substantially elevated above the pressure existing at the inlet of the pump. For example, with high density polyethylene (HDPE), the inlet pressure can be from about 30 to about 40 psig at from about 3500 to about 5500 Fahrenheit (F), whereas the outlet pressure can be from about 2,000 to about 3,000 psig at from about 375° to about 575° F.

The polymer fills the space between the teeth at the inlet side and is conveyed to the outlet side of the pump, after which the teeth are brought to their point of closest approach, i.e., cyclically into meshing engagement with one another, the engagement serving to exclude the polymer and generate pressure. The design of the teeth is such that the clearance between adjacent surfaces is minimized in part to prevent back flow of polymer from the high pressure outlet side of the pump back into the lower pressure inlet side. The greater this back flow of polymer, the less efficient the operation of the pump, causing the pump's turning speed to be increased to compensate, and wasting energy in the operation of the pump.

Accordingly, to prevent this undesired back flow of polymer, the registry of the pump teeth relative to one another when in meshing engagement must be timed to be very close, but without any actual physical contact of the meshed teeth. If the teeth contact one another when meshed, premature and undesired wear of the teeth occur thereby not only allowing back flow of polymer, but also requiring shutdown of the pump and an expensive, premature reworking of the worn teeth. Since each shaft of such a pump can cost as much as $100,000, it is desirable to maintain the non-touching registry of the teeth on these opposed shafts for as long as possible. For example, when the desired non-touching teeth registry is maintained, the operating life of such a pump can extend for up to 5 years, whereas if touching during pumping occurs, this life span can be reduced to 2 years at the very best.

However, to prevent polymer back flow, the gap (tolerance) between adjacent teeth when in meshing engagement must be quite small, about 0.02 of an inch in the case of HDPE. The opposing teeth bearing shafts are fixed relative to one another to maintain this non-touching timing.

When a pump is new and contains no polymer, the teeth are clean of polymer and the desired non-touching gap registry between adjacent meshed teeth can easily be achieved even in the field, e.g., when installed in the plant. This is so because one can readily obtain access to the interior of the pump and physically gauge the gap between adjacent meshed teeth before the opposing shafts are fixed to one another to maintain this registry while the pump is in operation.

However, from time to time, maintenance of gear boxes, couplings, and the like must be carried out on any pump, and at such times it may be necessary to stop the operation of the pump. This leaves the pump full of polymer, and its teeth covered with polymer. During such maintenance work, it may be necessary to remove the equipment that keeps the shafts and their teeth registry constant thereby causing the loss of the desired non-touching tolerance between adjacent meshed teeth. Since the pump is full of molten polymer, access to the interior of the pump to re-set the timing (registry) of the pump teeth is much more problematic. The polymer could be removed from the interior of the pump and from around the meshed teeth, but this is a time-consuming and costly approach.

It is much more desirable, and cost effective, to be able to re-set the timing of the pump teeth registry from outside the pump without requiring access to the interior of the pump, so that maintenance procedures can be completed. This invention provides such a method.

SUMMARY OF THE INVENTION

This invention provides a method for timing the registry of meshing polymer pumping teeth relative to one another while those teeth are immersed in molten polymer by employing a pattern of apertures on the ends of the shafts carrying those teeth and a template with holes there through that matches the pattern of apertures. The shafts are rotated until the pattern of shaft end apertures matches the pattern of template holes, and dowels having a tolerance relative to such apertures and holes of not more than about 0.001 of an inch are inserted into each matching aperture/hole set.

The dowels and template are then removed, and the thus registered pump shafts, and their teeth, are re-fixed relative to one another in conventional manner, and pumping resumed.

By this method, the gap between meshed teeth that are surrounded by molten polymer can be reliably set remotely from the interior of the pump thereby eliminating the need for emptying the pump of its polymer load.

DETAILED DESCRIPTION OF THE INVENTION

Although, for sake of clarity and brevity, this invention is described in detail herein with respect to pumping HDPE, it can be used in the pumping of any molten polymer.

Figure 1:
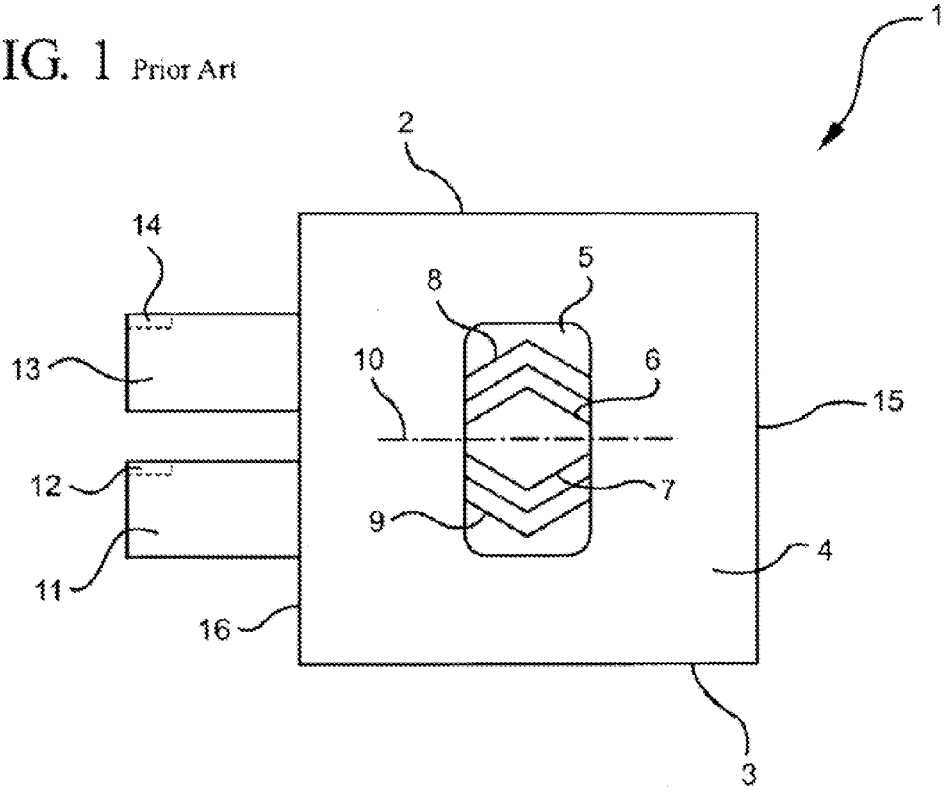
FIG. 1 Prior Art
FIG. 1 shows a plan view of the inlet side of a polymer pump.

FIG. 1 shows polymer pump 1 having a closed top 2 and closed bottom 3. Upstanding, spaced apart sides 15 and 16 support internally of pump 1 a pair of parallel, opposed shafts 11 and 13 that extend fully across the pump's interior (FIG. 4). Upstanding side 4 and an opposing upstanding side 20 (FIG. 3) complete the enclosure of the interior of pump 1.

Figure 6:
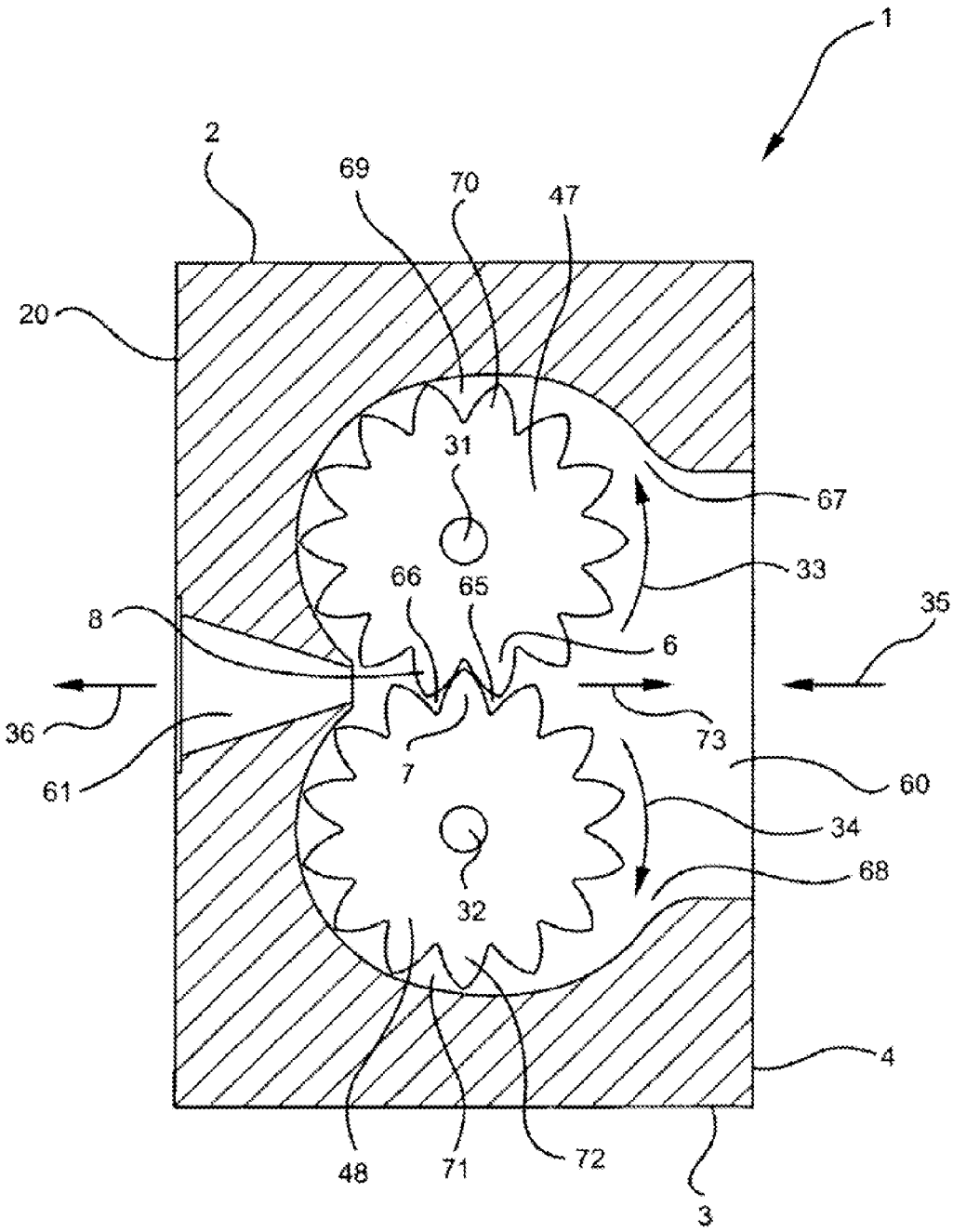
FIG. 6 Prior Art
FIG. 6 shows a cross-section of the pump of FIG. 1 with its opposed teeth carrying shafts.

Side 4 is the inlet side of pump 1. Side 4 has an opening 5 through which polymer is introduced into the interior of pump 1 to be forced to the outlet 21 (FIG. 2) of the pump. Through opening 5 pumping teeth (teeth) carried by shafts 11 and 13 can be seen. Shaft 11 carries chevron style teeth 7 and 9, while shaft 13 carries chevron style teeth 6 and 8. These teeth are shown in a more spaced apart configuration than actual for sake of clarity. The teeth shown are chevron style, but can be any style, including spur gear or single helical. Line 10 denotes the demarcation line between shafts 11 and 13 and is the line (point) of closest approach for teeth carried by opposing shafts 11 and 13 when those teeth are at their closest approach and in a meshed configuration (FIG. 6). Shafts 11 and 13 carry key ways 12 and 14 respectively so that shafts 11 and 13 can be fixed to one another by conventional apparatus (not shown) that maintains, while the pump is in operation, the non-touching registry between adjacent opposing teeth when at their point of closest approach.

Figure 2:
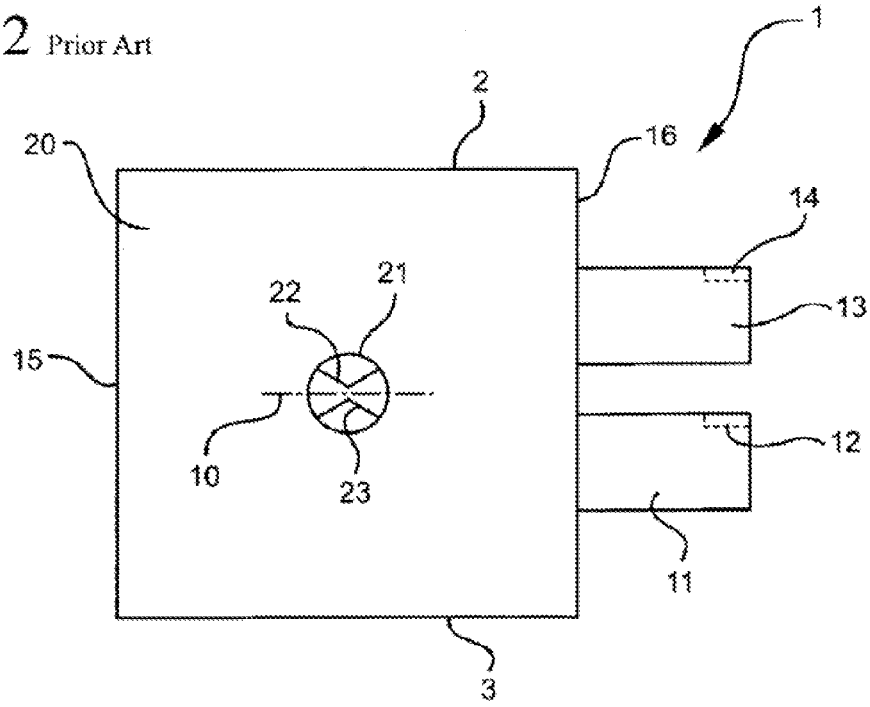
FIG. 2 Prior Art
FIG. 2 shows a plan view of the outlet side of the pump of FIG. 1.

FIG. 2 shows the outlet side 20 of pump 1 to carry an opening 21 to allow pressurized polymer to issue from the interior of the pump. FIG. 2 shows a pair of opposing chevron teeth 22 and 23 carried respectively by shafts 13 and 11 after they have pushed polymer toward opening 21 and as they near their line of closest approach 10 for meshing engagement thereof. Again, although a plurality of teeth are present around the entire periphery of both shafts 11 and 13 (FIG. 6), only two pairs of teeth are shown only for sake of clarity.

Figure 3:
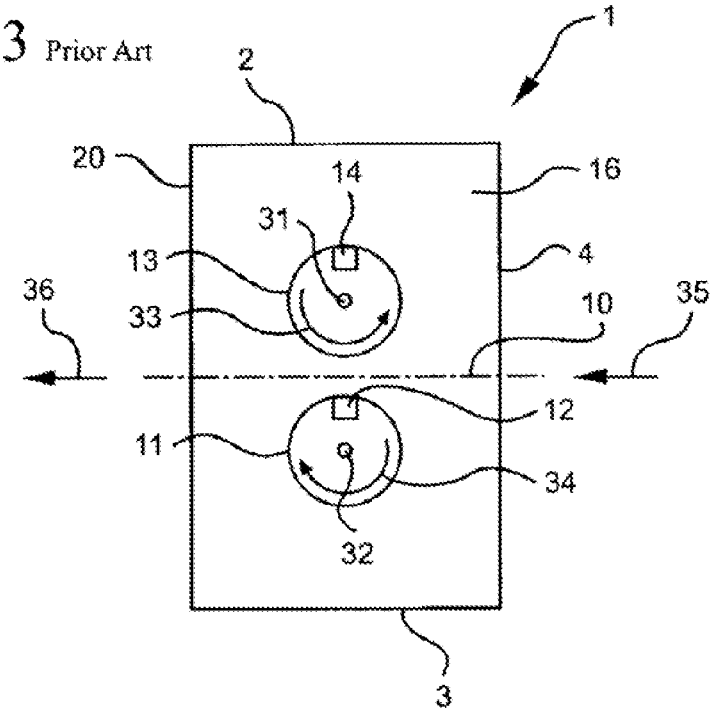
FIG. 3 Prior Art
FIG. 3 shows a side view of the normally exposed opposing shaft ends of the pump of FIG. 1.
Figure 4:
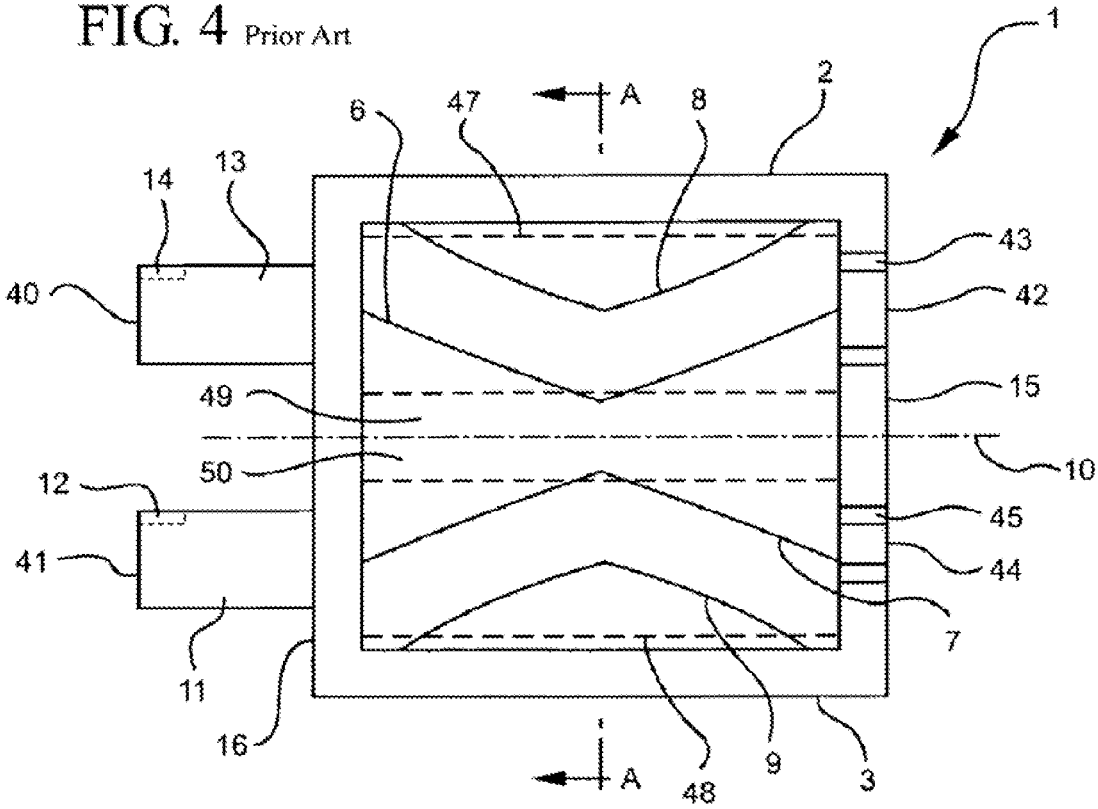
FIG. 4 Prior Art
FIG. 4 shows a view of FIG. 1 with its opposed, teeth carrying shafts exposed.

FIG. 3 shows the side 16 of pump 1 wherein shaft ends 11 and 13 are exposed outside the interior of pump 1. Shaft ends 11 and 13 have center points 32 and 31, respectively. The shafts rotate about their respective center points in the directions shown by arrows 33 and 34. Entering polymer shown by arrow 35 passes into inlet 5 (FIG. 1) wherein it is picked up by moving pumping teeth and forced to outlet 21 as shown by arrow 36, and as shown in greater detail in FIG. 6.

FIG. 4 shows the view of FIG. 1 with side 4 removed to reveal that shafts 11 and 13 extend across the full interior of the pump. Shaft 11 has an exposed end face 41 outside of the pump, while its opposing end 44 is carried in side 15 journaled in circular bearing 45. Similarly, shaft 13 has end face 40 that is exposed outside the interior of the pump, and an opposed end 42 journaled in side 15 in circular bearing 43.

FIG. 4 shows that shafts 11 and 13 are of substantially larger diameter inside pump 1, these larger diameter portions 47 and 48 being the part of the shafts that carries the pumping teeth. In this Figure, the pumping teeth spaces 49 and 50 for shaft parts 47 and 48, respectively, are shown to be relatively larger than normal for sake of clarity only, the teeth being relatively small compared to the diameter of parts 47 and 48. This is better shown in FIG. 6.

Figure 5:
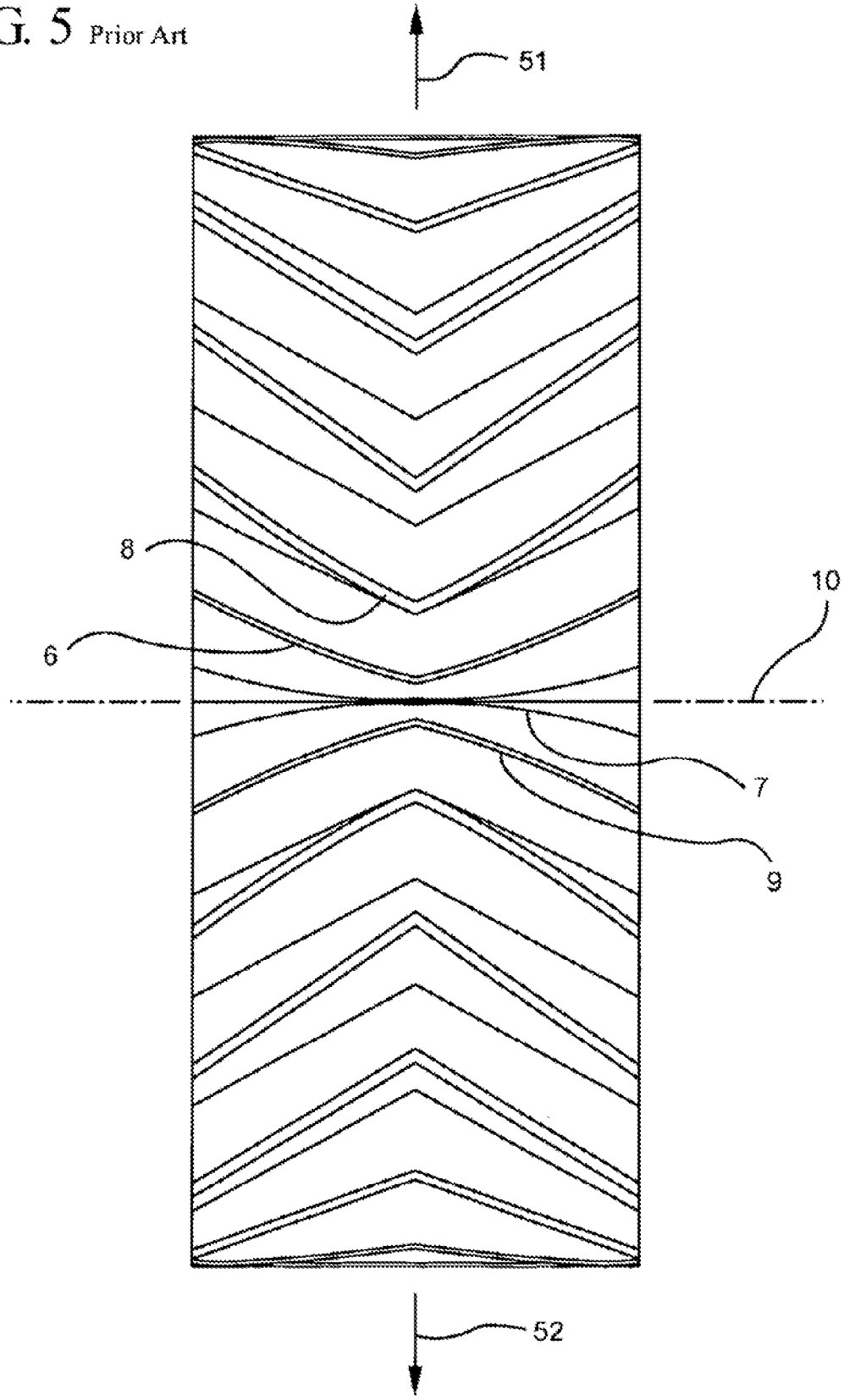
FIG. 5 Prior Art
FIG. 5 shows a close-up view of the pumping teeth shown in FIGS. 1 and 4.

FIG. 5 shows a plurality of teeth in general and a close-up of teeth 6 through 9 on the inlet side 5 (FIG. 1) in particular. FIG. 5 shows these teeth as they are rotated away from meshing along line of closest approach 10. In this mode, the teeth pickup additional polymer (not shown) and move it in a pumping mode. On the inlet side of the pump, upper teeth 6 and 8 on shaft part 47 are moving upwardly (and carrying polymer upwardly) as shown by arrow 51 while lower teeth 7 and 9 on shaft part 48 are moving downwardly (and carrying polymer downwardly) as shown by arrow 52. All of the moving teeth are carrying incoming polymer with them in the direction of their movement, whether up (arrow 51) or down (arrow 52). In this Figure, for example, when in the meshing configuration at line 10, tooth 7 was in between teeth 6 and 8, and, when so disposed, with proper pump timing registry, tooth 7 is maintained at its 0.02 inch tolerance with teeth 6 and 8. Thus, tooth 7 did not physically contact either of teeth 6 and 8, the tolerance being filled with polymer.

FIG. 6 shows vertical cross-section A-A of FIG. 5. FIG. 5 shows inlet opening 60 to be of substantially larger area and volume than outlet opening 61. Polymer entering at 35 is forced by its conveying teeth into progressively smaller volumes 67 and 68, and thereby put under substantially greater compressive forces when delivered to outlet 61. Thus, exiting polymer 36 is under a substantially higher pressure, e.g., 3000 psig, than entering polymer 35, e.g., 30 psig. This pressure differential can cause flow back in the direction of arrow 73 if the teeth carried by shaft parts 47 and 48 become worn by repeated physical contact between the opposing teeth when in their point of closest approach 10 (FIG. 4).

Cross-sectional FIG. 6 shows that after teeth 6, 7, and 8 have delivered their conveyed polymer through restricted passage ways 69 and 71 to outlet 61, these teeth then move into the meshing configuration of closest approach shown in FIG. 6. In this inter-meshing configuration, tooth 7 is physically disposed between and adjacent to teeth 6 and 8, but not physically touching either of those teeth. This is the point of closest approach 10 for these three teeth. The gaps 65, between teeth 6 and 7, and 66, between teeth 7 and 8, are both desirably maintained at the 0.02 inch registry tolerance mentioned hereinabove for HDPE. This prevents premature wear of these teeth when repeatedly put into and out of this meshed configuration during the pumping life of pump 1.

Initially, for example, when new, pump 1 is timed in a conventional manner well known in the art. After some operation of pump 1 so that it contains polymer in its interior, template 80 is prepared so that it is unique to the particular shafts of pump 1. Once made, the template can be used to restore pump 1 to its timed state at any time over the service life of that pump. If the teeth carrying shafts of pump 1 are re-used in another pump, template 80 could be used to establish proper timing for those shafts.

Figure 7:
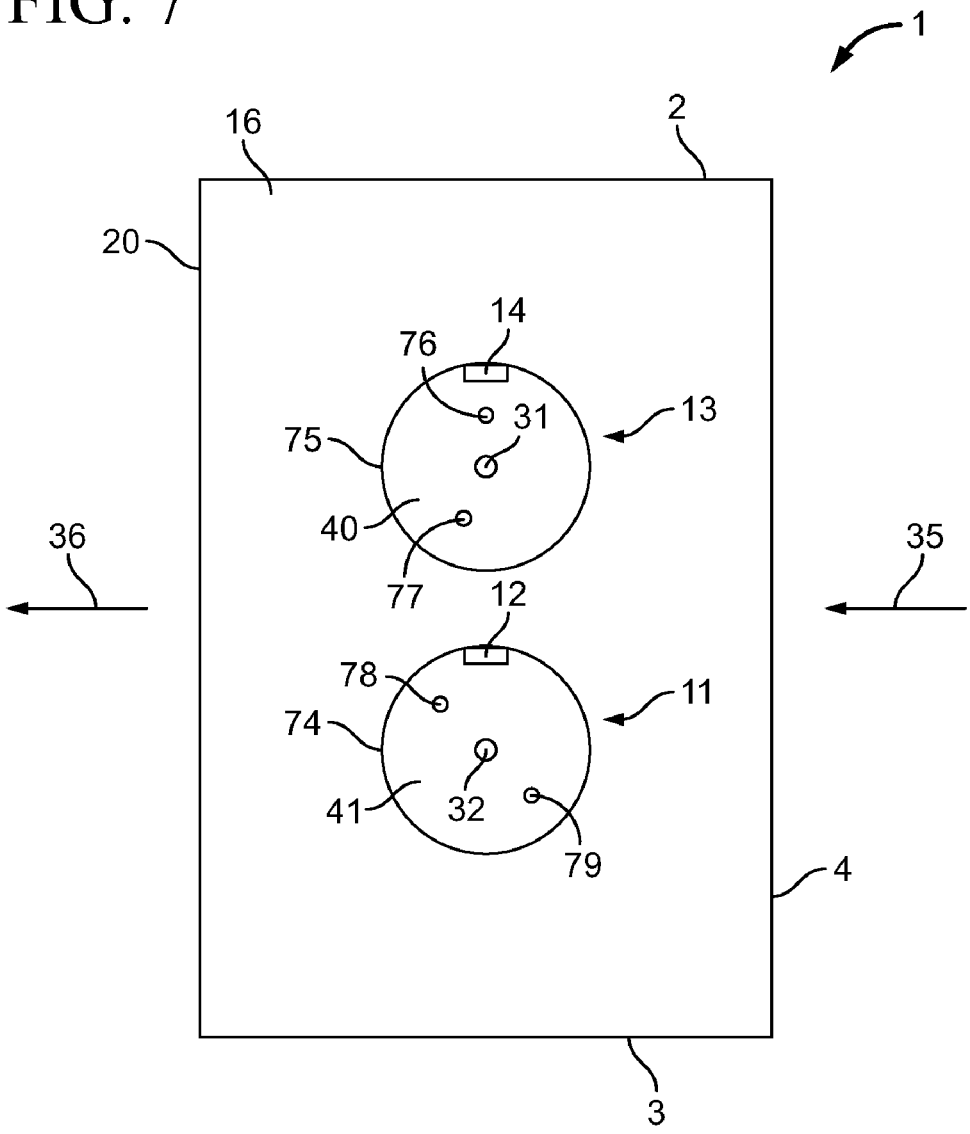
FIG. 7 shows the ends of the opposed shafts that normally extend outside of the interior of the pump of FIG. 1, and a pattern of apertures in those shaft ends pursuant to this invention.

FIG. 7 shows the first step in carrying out this invention. In this step, when pump 1 is not in operation and shafts 11 and 13 are in proper timing registry to maintain the desired 0.02 inch tolerance, shaft faces 40 and 41 are exposed, i.e., separated from the apparatus (not shown) that causes shafts 11 and 13 to stay in the desired registry during the operation of pump 1. Each exposed shaft face 40 and 41 has at least two spaced apart apertures drilled there into. In the case of face 40, apertures 76 and 77 are drilled a finite distance into the body of shaft 13. In this example, apertures 76 and 77 are placed asymmetrically on face 40 in that aperture 76 is further from center point 31 and closer to outer periphery 75 of shaft 13 than is aperture 77. Apertures 78 and 79 are shown in this example to be drilled symmetrically into the body of shaft 11. That is, apertures 78 and 79 are each located an equal distance above and below center point 32 (an equal distance from outer periphery 74).

Figure 8:
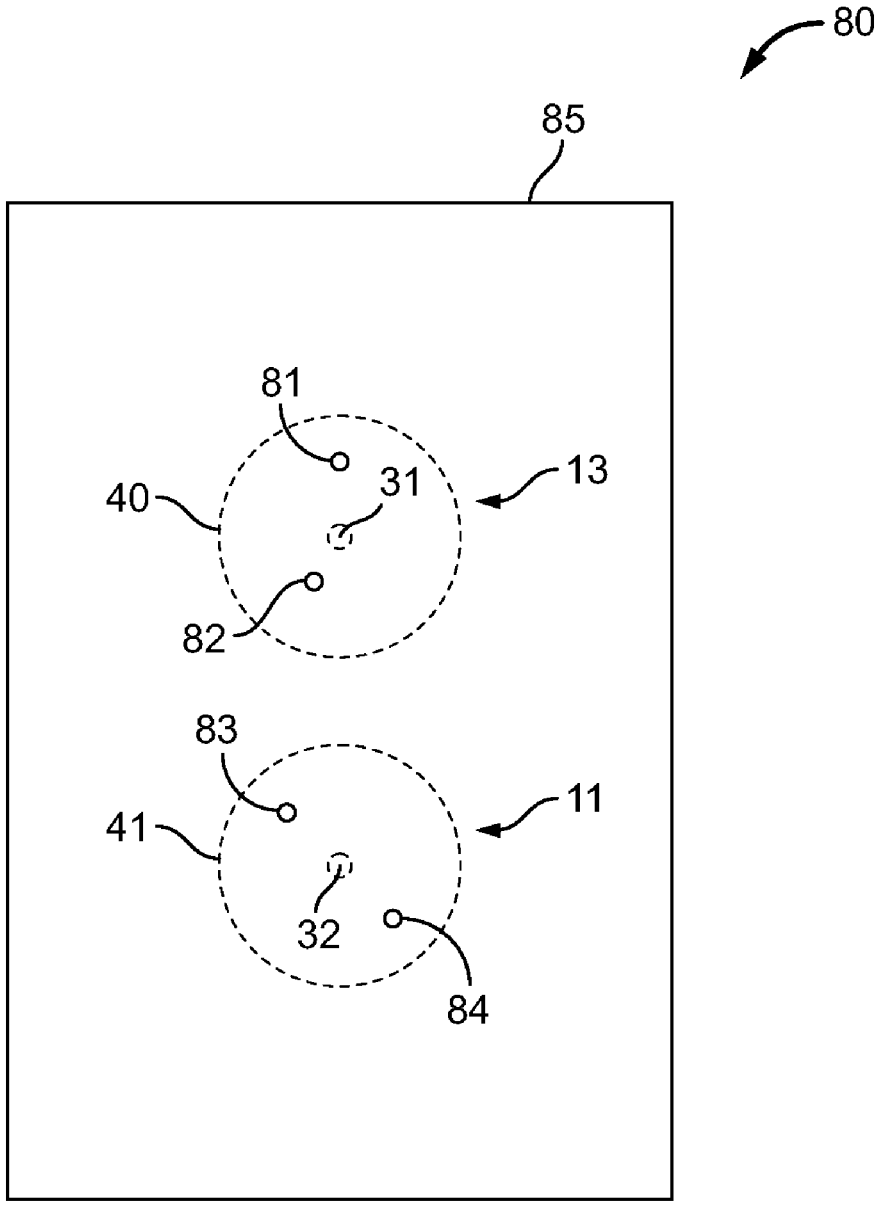
FIG. 8 shows a template useful in the process of this invention.

FIG. 8 shows a separate, unitary template member 80 that is employed in this example of the process of this invention.

Template 80 is co-extensive with shafts 13 and 11 in that it essentially covers at least a substantial area of shaft end faces 40 and 41.

A pattern of holes 81 through 84 is provided which holes extend fully through template 80. This pattern of holes is made to match the pattern of apertures 76 through 79 in end faces 40 and 41 (FIG. 7)

With a symmetrical aperture pattern 78/79 such as that shown for shaft 11 there is more than one way (front or back side) template 80 can be held up to shaft ends 40 and 41 and the hole pattern 83/84 matched (aligned). However, with asymmetrical aperture pattern 76/77 there is only one orientation in which template 80 can be held up to shaft ends 40 and 41 and hole pattern 81/82 matched to pattern aperture 76/77. Thus, pursuant to this invention, at least one of shafts 11 and 13 will have an asymmetrical aperture pattern. If desired, both shafts can have an asymmetrical shaft pattern with their asymmetries the same or different.

Figure 9:
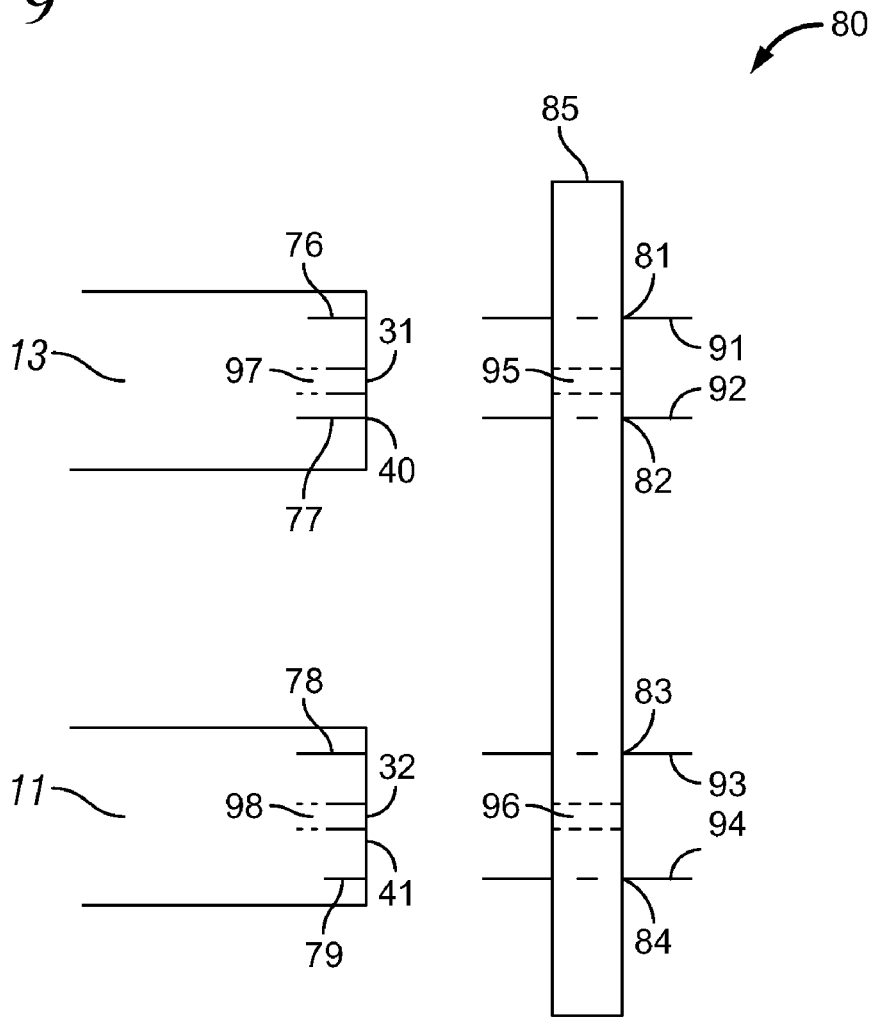
FIG. 9 shows an exploded view of the template of FIG. 8 when employed relative to the shaft ends of FIG. 7 with dowels fitting the pattern of shaft end apertures and the pattern of template holes after those patterns are matched with one another.
Figure 10A:
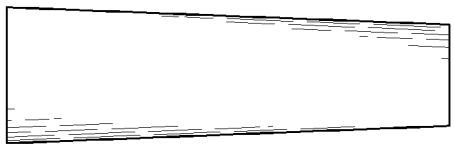
FIGS. 10A, 10B, and 10C show various views of a tapered dowel.
Figure 12A:
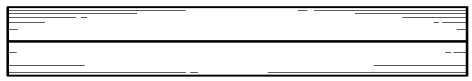
FIGS. 12A, 12B, and 12C show various views of a dowel with a polygonal cross-section.
Figure 10B:
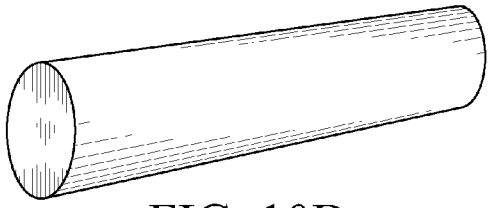
Figure 12B:
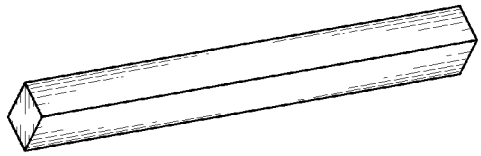
Figure 10C:
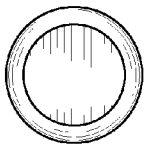
Figure 12C:
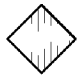
Figure 11A:
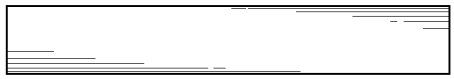
FIGS. 11A, 11B, and 11C show various views of a dowel with a curvilinear cross-section.
Figure 13A:
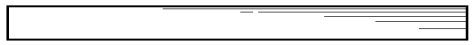
FIGS. 13A, 13B, and 13C show various views of a dowel with a curvilinear cross-section.
Figure 11B:
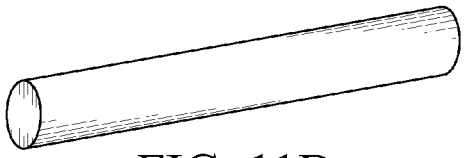
Figure 13B:
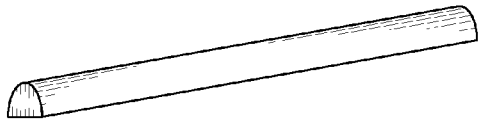
Figure 11C:
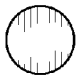
Figure 13C:
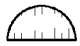

FIG. 9 shows an exploded view in respect of template 80 being held adjacent (abutting) faces 40 and 41 in order to match the aperture patterns of faces 40 and 41 to the hole patterns of template 80. If pump 1 is out of timing, the patterns cannot be made to match. In such a case, one or both of shafts 11 and 13 are rotated until the patterns can be made to match exactly. Dowels are then inserted through the template holes into the shaft apertures.

To ensure that the desired gap, e.g., 0.02 of an inch for HDPE, is obtained between the teeth then meshing inside the pump, the tolerance between the dowel inserted and the hole/aperture pair in which it is inserted should not be greater than about 0.001 of an inch.

FIG. 9 shows template 80 essentially up against, but not touching shaft faces 40 and 41 for sake of clarity only. In practice, template 80 will be firmly touching faces 40 and 41. This can be achieved in any desired manner known in the art such as drilling and tapping either or both of center points 31 and 32 to form a threaded opening 95, 96, 97 and 98 to receive a holding bolt (not shown) that temporarily affixes template 80 to shafts 11 and 13. With template 80 in place abutting faces 40 and 41, dowels 91, 92, 93, and 94 are inserted, respectively, through holes 81, 82, 83, and 84, and fully into apertures 76, 77, 78, and 79. When template 80 is firmly abutting faces 40 and 41 with the template hole/shaft aperture patterns matching, and dowels firmly inserted through the holes into the apertures, the desired timing registry between the meshing teeth inside the pump is achieved even though those teeth are covered with polymer.

Dowels 91 through 94 are then removed from their apertures, and template 80 removed from contact with faces 40 and 41. Shafts 11 and 13 are then re-attached to the apparatus (not shown) that is normally used during pump operation to maintain these shafts in their desired registry, and operation of the pump begun.

A matching template hole/shaft end aperture pair can be straight sided or tapered. In a specific embodiment, hole/aperture pairs can be straight sided, tapered, or a combination of such pairs. If a hole/aperture pair is tapered, the taper should be uniform from the start of the hole to the end of the aperture so that the mating dowel, with its close tolerance, can tightly and uniformly follow the taper angle from the start of the hole to the end of the aperture.

The cross-section of the dowels used can be curvilinear, polygonal, or any desired combination thereof.

All apertures need not be drilled to the same depth in the shafts. If desired, apertures can be drilled to differing depths with dowels being sized in length to match those depths in order to give an added dimension of asymmetry. More than two apertures can be employed on a given shaft face.

The cross-sectional distance across a shaft aperture and/or template hole, e.g., the diameter for a straight sided matching aperture/hole pair that is round, can be at least ⅛th of an inch, and preferably not more than about 1 inch. The apertures in the shaft ends can vary in depth from about ½ to about 1 inch.

The template itself can be any rigid member such as carbon steel plate at least ½ inch in thickness. The dowels can be solid metal members and should not be semi-rigid or otherwise flexible such as are hollow roll pins and the like.

We claim:

1. A method for restoring the registry of meshing pump teeth relative to one another in a polymer pump while said pump is not in operation and contains polymer, said meshing pump teeth being carried on opposed rotating shafts that cyclically move their opposing teeth into and out of meshing configuration, said registry being obtained without removal of said polymer from said pump and said teeth, said opposed shafts having at least one set of adjacent ends exposed outside said pump, providing in each of said adjacent shaft ends at least two apertures thereby forming a pattern of apertures in said adjacent shaft ends, said apertures being asymmetric relative to one another in at least one of said adjacent shaft ends, providing a template that is co-extensive with both said adjacent shaft ends and has a pattern of holes there through that match said pattern of apertures in said adjacent shaft ends, providing dowels that fit said apertures in said adjacent shaft ends and said holes in said template with a tolerance of not greater than about 0.001 of an inch, rotating said adjacent shafts relative to one another until said pattern of apertures in said shaft ends align with said pattern of holes in said template, passing said dowels through said template holes and into the interior of said apertures in said adjacent shaft ends thereby registering the timing of said shafts so that said pump teeth do not contact one another when said pump is put into operation.

2. The method of claim 1 wherein said apertures in each of said adjacent shaft ends are asymmetrical.

3. The method of claim 1 wherein said apertures in said adjacent shaft ends and said holes in said template are straight sided.

4. The method of claim 1 wherein at least one of said apertures in at least one of said adjacent shaft ends and its matching hole in said template are both tapered, and the dowel is tapered to match said tapered aperture/hole pair.

5. The method of claim 1 wherein said dowels are at least one of curvilinear and polygonal in cross-section.

6. The method of claim 1 wherein said apertures in said adjacent shaft ends are of differing depths and said dowels are sized to match said differing depths.

* * * * *